US005694994A

United States Patent [19]

Engler, III et al.

[11] Patent Number: 5,694,994

[45] Date of Patent: Dec. 9, 1997

[54] MULTI-PURPOSE JIG FOR PORTABLE ROUTER

[75] Inventors: Nicholas A. Engler, III, West Milton; James M. McCann, Brookville, both of Ohio

[73] Assignee: Bookworks, Inc., West Milton, Ohio

[21] Appl. No.: 527,131

[22] Filed: Aug. 1, 1995

[51] Int. Cl.[6] ..... B27C 9/00; B25H 1/00

[52] U.S. Cl. ..... 144/286.1; 83/574; 144/48.7; 144/84; 144/134.1; 144/135.2; 144/253.2; 144/251.2; 409/230

[58] Field of Search ..... 144/1.1, 48.7, 144/134.1, 135.2, 253.1, 253.2, 251.2, 84; 83/574; 409/230; 108/113, 62, 44, 8

[56] References Cited

U.S. PATENT DOCUMENTS 4,733,704 3/1988 Wolff ..... 144/286.1
5,239,934 8/1993 Miller et al. ..... 144/286.1
5,398,740 3/1995 Miller ..... 144/286.1
5,431,206 7/1995 McAllister ..... 144/286.1

*Primary Examiner*—W. Donald Bray
*Attorney, Agent, or Firm*—Joseph G. Nauman

[57] ABSTRACT

A multi-purpose routing jig comprised of a set of box type truss members which can be made of plywood or the like and may be assembled with butt joints, glue, and screws or bolts, which members can be quickly assembled or disassembled without use of other tools. The structure of the jig comprises the series of truss members which when fastened together in its primary bench-type configuration holds the router internally, in inverted position, with the bit positioned for easy and accurate access to various workpieces. The jig can fasten together in different configurations to make a) a router table and fence, b) a freehand router table, c) a joint maker or horizontal router, c) an overhead router, d) a dado and rabbet cutter, e) an edge guide, and f) an extended portable router base.

22 Claims, 8 Drawing Sheets

MULTI-PURPOSE JIG FOR PORTABLE ROUTER

FIELD OF THE INVENTION

This invention relates to a multi-purpose bench type device, e.g. a jig, for mounting a portable router for use in various modes.

BACKGROUND OF THE INVENTION

It is possible to do many woodworking tasks with a portable router held in a conventional router table, but these tables have their shortcomings. On occasion the worker encounters a task that could be done better with an overhead router, a joint maker, or some other routing fixture. Unfortunately many wood workers, especially amateurs, do not have the money or the shop space for large, expensive routing tools that will be used only occasionally.

Also, it has been noted that even an expensive top-of-the-line router table has a number of limitations. To overcome these, various single purpose jigs have been designed to provide the additional routing capabilities needed. In working with such table and jigs potential additional uses have been noted and this led to a desire for a single jig system capable of serving a large number of routing needs. Thus, there was established a need for a multi-purpose routing jig that converts to make a router table, overhead router, joint maker, and a number of other useful woodworking tools, yet costs no more to construct than an ordinary router table, and occupies the same space.

Part of this process led to the invention of an advanced router baseplate as disclosed in copending U.S. patent application Ser. No. 08/276,305 filed 18 Jul. 1994 now U.S. Pat. No. 5,452,751 issued 26 Sep. 1995, and assigned to the same assignee as this application. That baseplate has multiple purposes for portable routing tasks.

SUMMARY OF THE INVENTION

The multi-purpose routing jig of this invention is comprised, basically, of a set of simple box type truss members. These members can be made of plastic, metal, plywood or the like, and can be cast in a mold or are capable of assembly with butt joints, glue, and screws or bolts. The invention provides an auxiliary to a portable router enabling its use as a bench-type tool. There are commercially available router tables, some of which also support inverted sabre saws or other power hand tools, but those tables at best can only fold for storage or transportation and are thus rather bulky and clumsy to transport, as to a job site.

This invention also provides a robust router support and jig which can be quickly assembled or disassembled without use of other tools. The structure of the jig comprises a series of truss members, preferably box-like rigid parts each of which has substantial rigidity, which when fastened together in its primary bench-type configuration holds the router internally, in inverted position, with the bit positioned for easy and accurate access to various workpieces.

This design makes the multi-purpose jig simpler to build than a router table, and yet it can accomplish much more. By itself, the jig can convert to seven useful tools. If one uses the aforementioned multi-purpose advanced baseplate to mount a portable router in the jig, it will do the work of eight more, thus achieving the capability of fifteen different routing tool accessories in a single easy-to-use system.

The boxes, base, brackets, and guards that make up the novel jig (which is known as the Router PowerShop) fasten together in different configurations to make a) a router table and fence, b) a freehand router table, c) a joint maker or horizontal router, d) an overhead router, e) a dado and rabbet cutter, f) an edge guide, and g) an extended portable router base.

The object of this invention, therefore, is to provide a multi-purpose jig for a portable power router, which jig is useful as a bench top type of device and the components of which are capable of connecting to each other in a number of configurations for different woodworking (or the like) functions, by changing the manner in which its components are interconnected; to provide such a jig in which various component configurations and connections can be accomplished without need for other tools; to provide such a jig which keeps all its components connected for storage purposes; and to provide such a jig which can be built from readily available materials by non-professional wood workers.

Other objects and advantages of the invention will be apparent from the following description, the accompanying drawings and the appended claims.

DESCRIPTION OF THE PREFERRED EMBODIMENT

Figure 1:
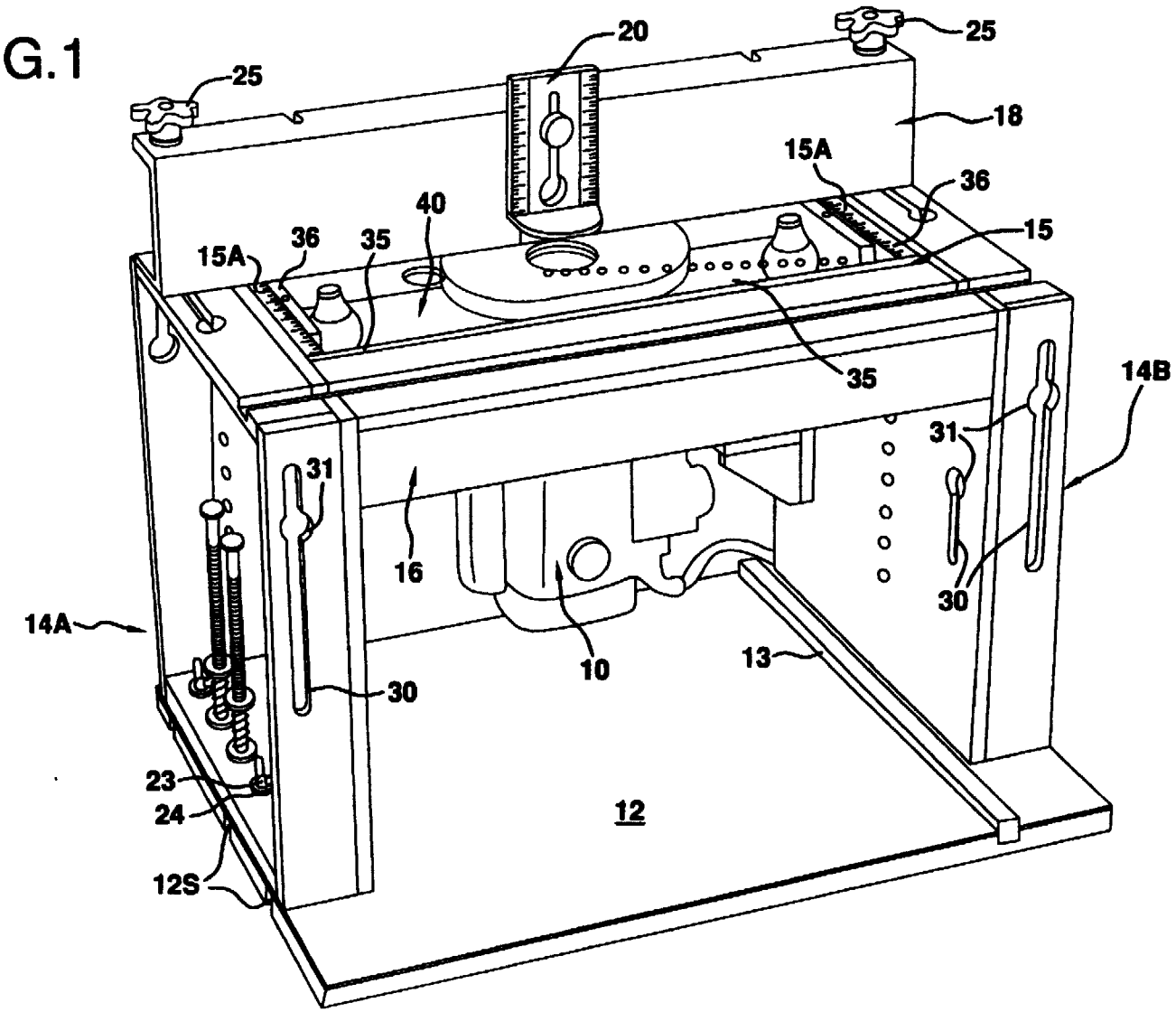
FIG. 1 is a perspective view showing the multi-purpose jig in a router table configuration.

Referring to the drawings, the present invention provides a sturdy "break-down" structure which is uniquely designed for supporting a portable router, although the principles of the invention are applicable to supporting other types of tools used for working on pieces of wood or like material. The portable router 10 (FIG. 1) is of standard design, such as supplied by a number of manufacturers of wood working tools. In general, such routers have a high speed motor mounted on a base 10B (FIG. 8), a motor shaft 10S with a collet extending in alignment with a hole or aperture in such base 10B, and a pair of handles 10H normally used to support and maneuver the router as a portable tool using a rotating cutter or bit 10C attached to its drive shaft by the collet and extending through the tool base. A plunge router will also have provisions for adjusting the shaft axially through the base center hole to adjust depth of cut.

Figure 2:
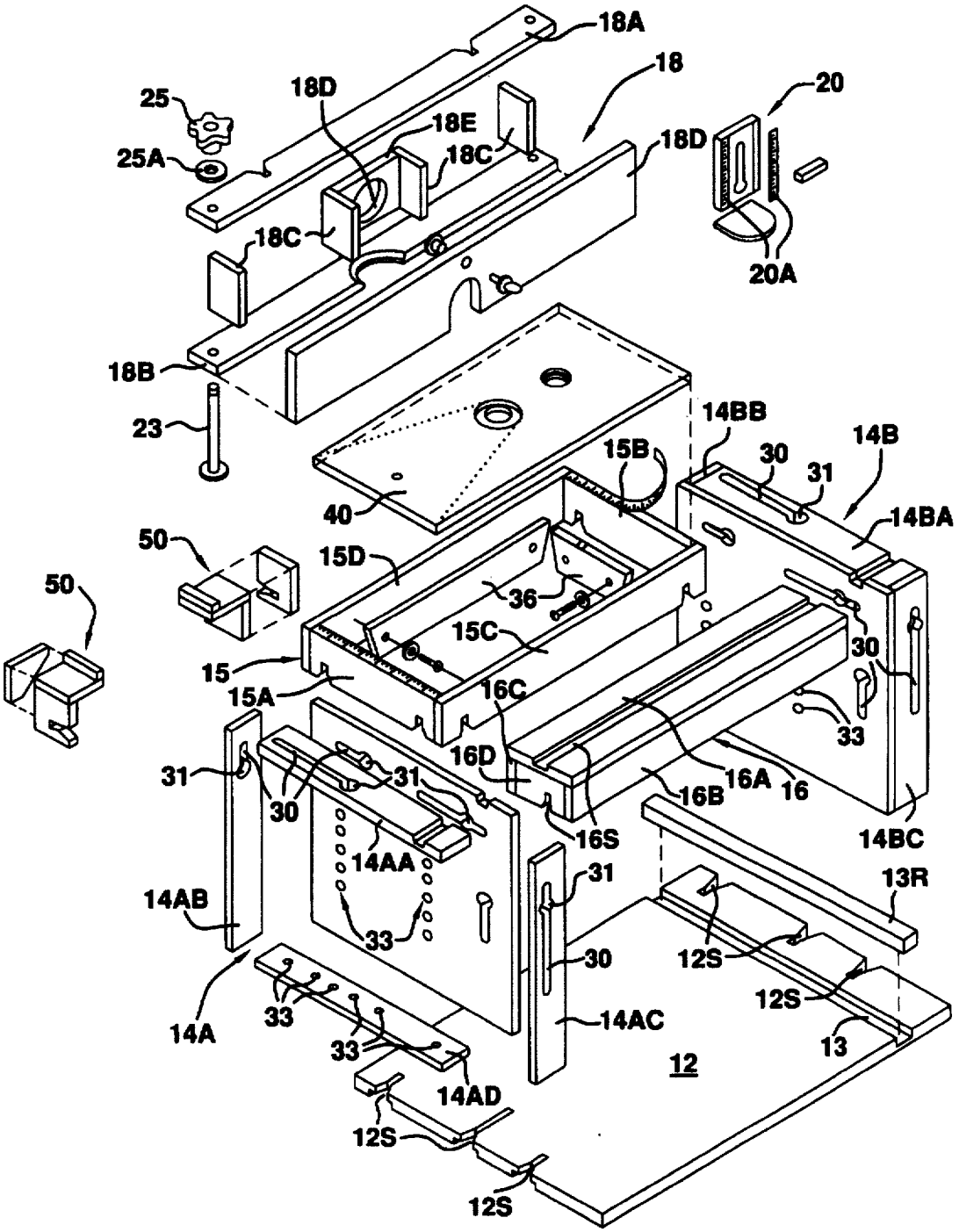
FIG. 2 is an exploded perspective view showing all the truss members and their individual parts.

FIG. 2 shows the jig disassembled, in an exploded perspective view including a flat base member, all five truss-like boxes, brackets, guards, and hardware. The five boxes include two support boxes, a plate box or bridge (which holds the router on a mounting plate), an auxiliary bridge or extension box, and a fence box. There are also two wooden brackets, two plastic safety guards, and an assortment of common hardware. All the wooden parts may be made from ½-inch plywood (Baltic birch or Apple-Ply plywood are recommended) for stability and strength, or such parts may be cast from plastic or metal.

In FIG. 2, these parts are a base 12, at least two side or support structures 14A, 14B that preferably are symmetrical, a mounting plate or bridge 15, an auxiliary or extension bridge 16, and a fence 18. The box shaped truss members are each a strong rigid structure, and fastening several of these members together forms a rigid truss, which is even stronger. Base 12 has a renewable hardboard upper surface, a plurality of outward opening assembly slots 12S, and has a front-back slot 13 therein to receive a renewable stop rail 13R.

Each of the truss member parts, have a box construction as noted. Thus the fence 18 includes a top 18A, bottom 18B, inner and outer ribs 18C, a front 18D and a partial back 18E, which are secured to top 18a and bottom 18B forming a rigid, truss-like member. Fence front 18D and bottom 18B have half-round openings to surround the router bit, and back 18E has a circular opening 18P for dust collection. The inner ribs 18C and partial back 18E form a dust and chip collector which can have a vacuum hose attached thereto. There is a fence guard 20 fitted with scales 20A, which can be adjustably (upward-downward) attached to fence front 18D.

In addition to incremental positioning, the scales on the fence guard 20 also serve as a built-in depth gauge. By detaching the guard, and setting it next to the bit, it can be used to measure the height of the bit above the mounting plate, i.e. depth of cut. The two scales permit reading the depth of cut in either 1/32-inch or 1/64-inch increments.

Similarly, the sides or supports 14A and 14B of the jig have tops 14AA, 14BA, and sides 14AB, 14BB, 14AC, 14BC, and bottoms 14AD, 14BD. These are secured together forming two more rigid truss-like members and which are complementary to each other (e.g. left side and right side). The bridge 15, which forms the table of the device when it is fully assembled, and which supports the router 10 and extended baseplate 40 (see below), comprises sides 15A, 15B, a front 15C, and a back 15D. Bridge extension 16 includes a top 16A, sides 16B, 16C, and ends 16D, 16E. A guide slot 16S extends the length of its top part 16A.

The base, supports, bridge and auxiliary, and the fence are attached in various configurations by removable fasteners, such as round-head bolts 23 (e.g. carriage bolts with a domed head and square under-head configuration) and cooperating wing nuts 24, threaded knobs 25, and washers 25A shown in position in various ones of FIGS. 1–8, and shown in stowed location in FIGS. 1, 3, 4 and 5. These attachments can be engaged and released by hand, as will be apparent, without using further tools, and can be stored in the jig (see FIGS. 1, 3 & 4). Slots 30 where appropriate have an access hole 31 slightly larger than the heads of bolts 23, e.g. a so-called "key-hole" slot. These access holes allow inserting the bolts in the slots and removing them without having to remove the washers and wing nuts from the bolts. In most cases, all that is needed is to loosen wing nuts 24 or knobs 25 to change the jig from one configuration to another. Additionally, most wing nuts face out so they are easily reached.

Specifically, referring to FIG. 1, the side or support structure 14A has keyhole slots 30 formed therein on three sides indicated at 14AA, 14AB and 14AC, and the fourth side 14AD has a series of holes 33 formed therein (see FIG. 2). Sets of further holes 33 are formed in two vertical rows along the sides of supports 14A, 14B. Side structure 14B has similar slots and holes. Base 12 has side opening slots 12S which are enlarged at the bottom of base 12 to recess the bolt heads. Thus the supports 14A, 14B are secured to base 12 by sets of bolts 23 and mating wing nuts 24 which can be hand tightened and loosed to secure the supports to base 12. The same form of releasable attachment secures bridge 15 between the supports 14A, 14B (see also FIG. 3) using bolts and wing nuts. When thus assembled these four parts constitute a rigid box, open at the front and rear.

The inner surface of bridge 15 has a frame-like rectangular aperture or shelf 35, formed by front, back, and side ledger plates 36. Aperture 35 is dimensioned to receive an auxiliary baseplate 40 from which router 10 is suspended. The auxiliary baseplate 40 may be a rectangle of any suitable material to which a portable router 10 is secured, but is preferably of the type disclosed in the aforementioned co-pending U.S. patent application Ser. No. 276,305 filed 18 Jul. 1994. Such multi-purpose baseplate is formed of a transparent acrylic material with various guide markings, etc. formed therein as disclosed in said application. The baseplate 40 is attached to ledger plates 36 by suitable screws (not shown).

At the front of bridge 15 is the auxiliary bridge member 16, also fastened to the bridge and to supports 14A, 14B by appropriate bolt/nut fasteners, with a longitudinally extending guide slot 16S. This guide slot arrangement is extended into to support sides 14AA and 14BA, as shown in FIGS. 1 and 2.

Router Table and Fence

FIG. 1 shows how the components fit together to make a bench type router table with a fence. To configure the jig in this way, side supports 14A, 14B are attached to base 12 extending vertically. The bridge extension 16 is secured to the front of bridge member 15, and these are secured between the side supports 14A, 14B. The fence 18 is then fastened to the top of this assembly with long bolts and knobs 25, and the fence guard 20 is fitted to the fence. The fence has top-mounted locking knobs 25 for ease of use avoiding the need to reach under the work surface to adjust the fence position.

Centering scales 15A on the right and left sides of the bridge help to position the fence accurately in relation to the router bit. By themselves, these scales provide adjustment of the fence within 1/16 inch. If used in combination with the scales on the fence guard 20, it is possible to adjust the bridge to within 1/64 inch. And by moving just one side of fence 18, its position relative to the bit can be changed in 1/128-inch increments.

This configuration is useful for shaping, molding, and cutting joinery in small and medium-size boards when a straight surface is needed to guide the work. Piloted bits may be used to cut contoured molding and edge rabbets in small and medium-size boards. If routing the edge of a workpiece, the workpiece is fed across the bit by pushing it along the fence. If routing an end of a workpiece, the end is placed under guard/gauge 20 and is made to butt against the fence as it is fed under guard 20 past the bit.

When in the router table configuration, the jig's work surface, e.g. baseplate 40 and bridge 15, can tilt up to provide easy access to the router bit and collet. If the bolts holding the bridge 15 and the extension 16 to support boxes 12A, 12B, are loosened the front edge of the extension box can be lifted. One of the edge guide brackets (as later described) can be used to support the combined bridge and baseplate, with the router attached, at an angle. This permits changing bits and adjusting the depth of cut without having to stoop down.

Freehand Router Table

Figure 3:
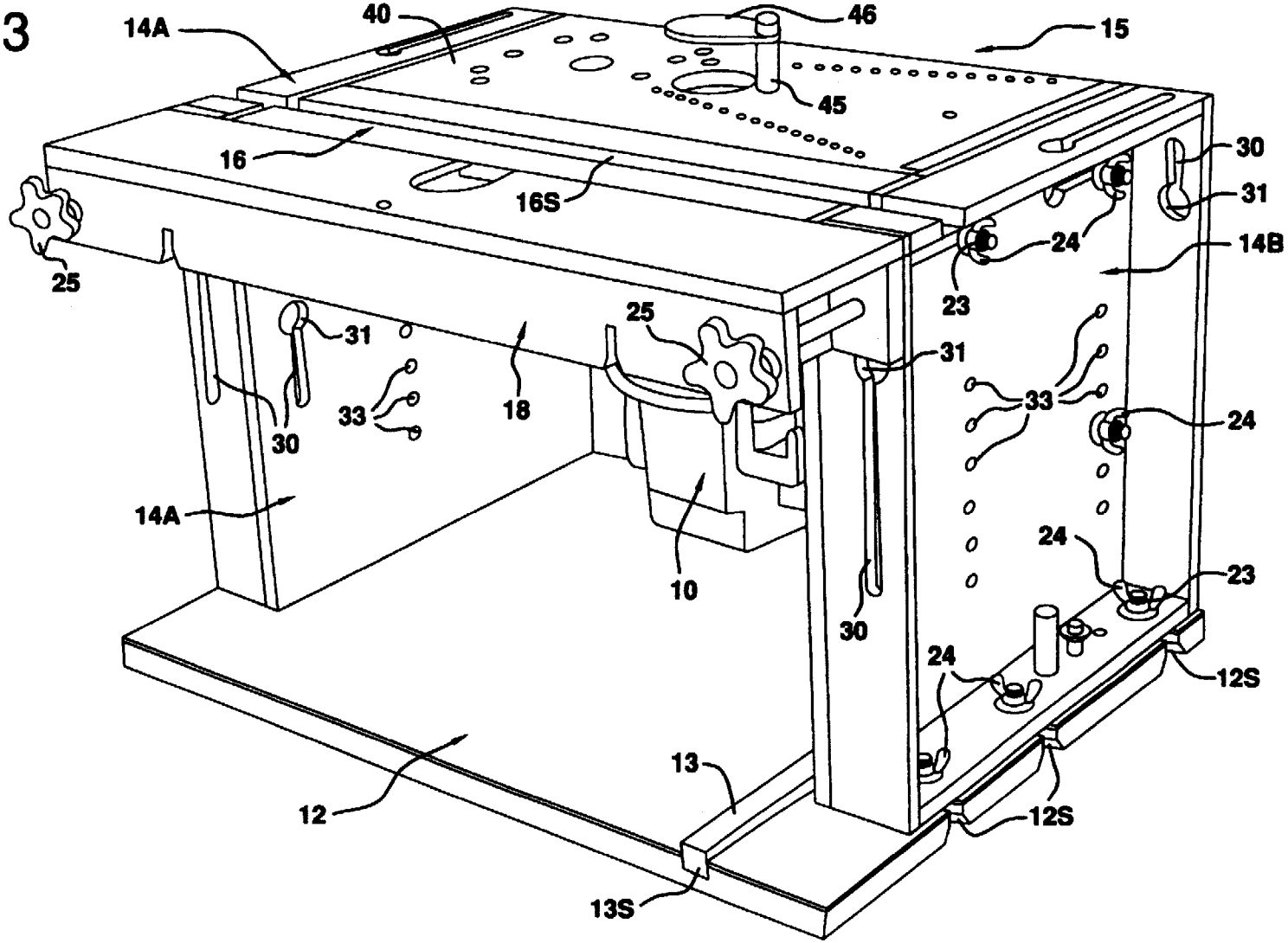
FIG. 3 is a perspective view showing the multi-purpose jig in the freehand routing configuration.

FIG. 3 shows how the components fit together to make a freehand router table. The starter pin 45 and its pin guard 46 are mounted in place on baseplate 40, with the guard centered over the router bit. Since a fence is not required, the supports 14A, 14B, bridge 15 and extension bridge 16 are assembled as described previously. Then fence 18 is attached to the front (or back) of that assembly to function as a further table extension. Using baseplate 40 the router 10 is mounted in inverted (bit up) position.

In this freehand table configuration, the jig lets the user shape curved edges with piloted bits, resting or moving an edge of the workpiece against the starter pin as needed.

Joint Maker or Horizontal Router

Figure 4:
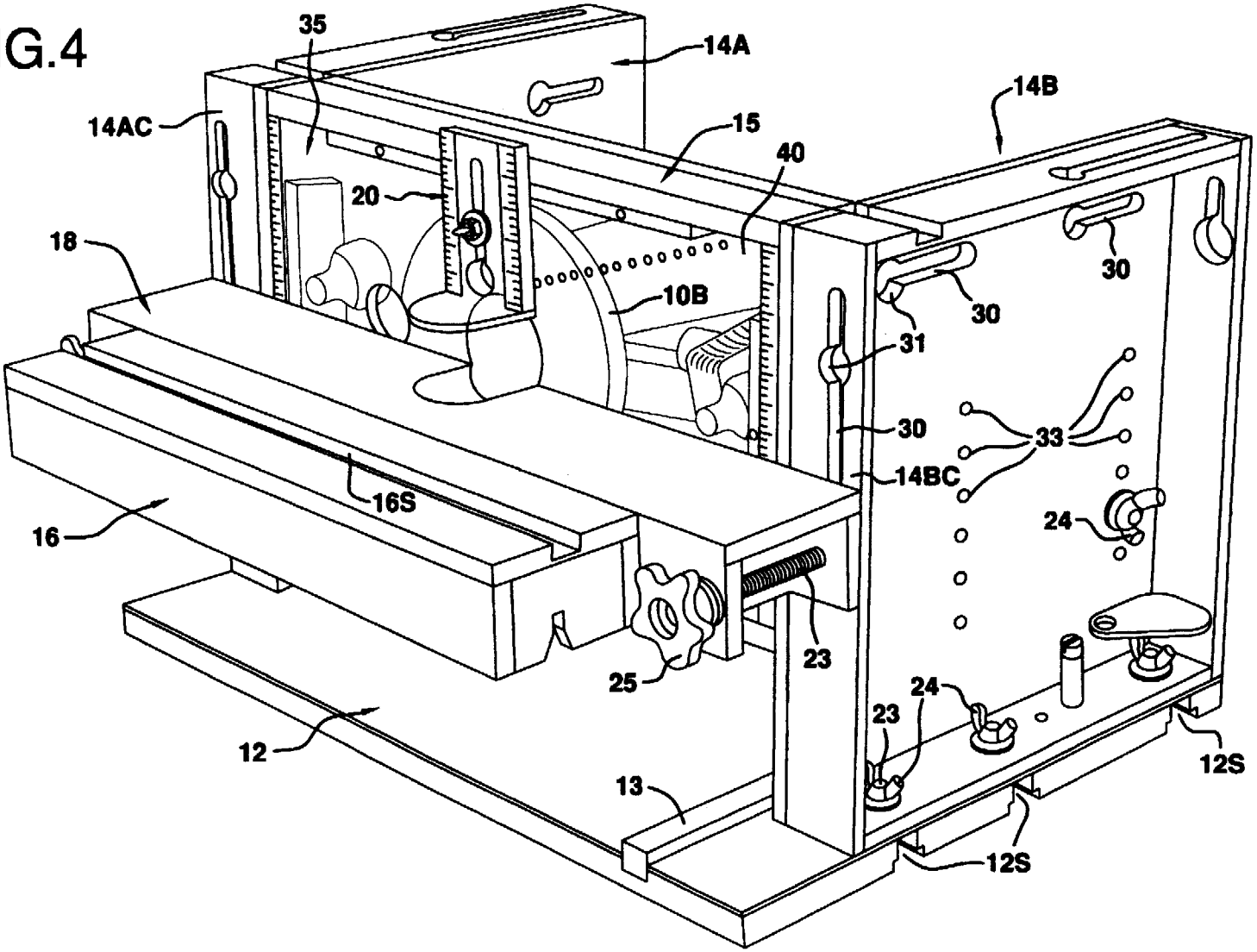
FIG. 4 is a perspective view showing the multi-purpose jig in the joint maker configuration.

FIG. 4 shows the components assembled as a joint maker. Some routing operations are easier and more comfortable with the router held beside the work. To mount the router horizontally, supports 14A, 14B are attached to base 12 extending perpendicularly (as above), and bridge 15 is attached between them so mounting plate 40 is vertical and flush with the support box fronts 14AC and 14BC. Extension box 16 is attached to fence box 18, then the two are mounted to the front of the assembly. Fence guard 20 is attached to baseplate 40.

With router 10 thus horizontal, the jig becomes a joint maker. This configuration is especially useful for making mortises, tenons, and other woodworking joints. It can also be used to shape wood panels using vertical raised paneling bits (in this configuration bits will held on a horizontal axis). The user can guide the workpiece along the baseplate 40 in bridge 15, using fence 18 and the bridge extension 16 as a work surface. The workpiece can be fed by hand or using a miter gauge.

Overhead Router

Figure 5:
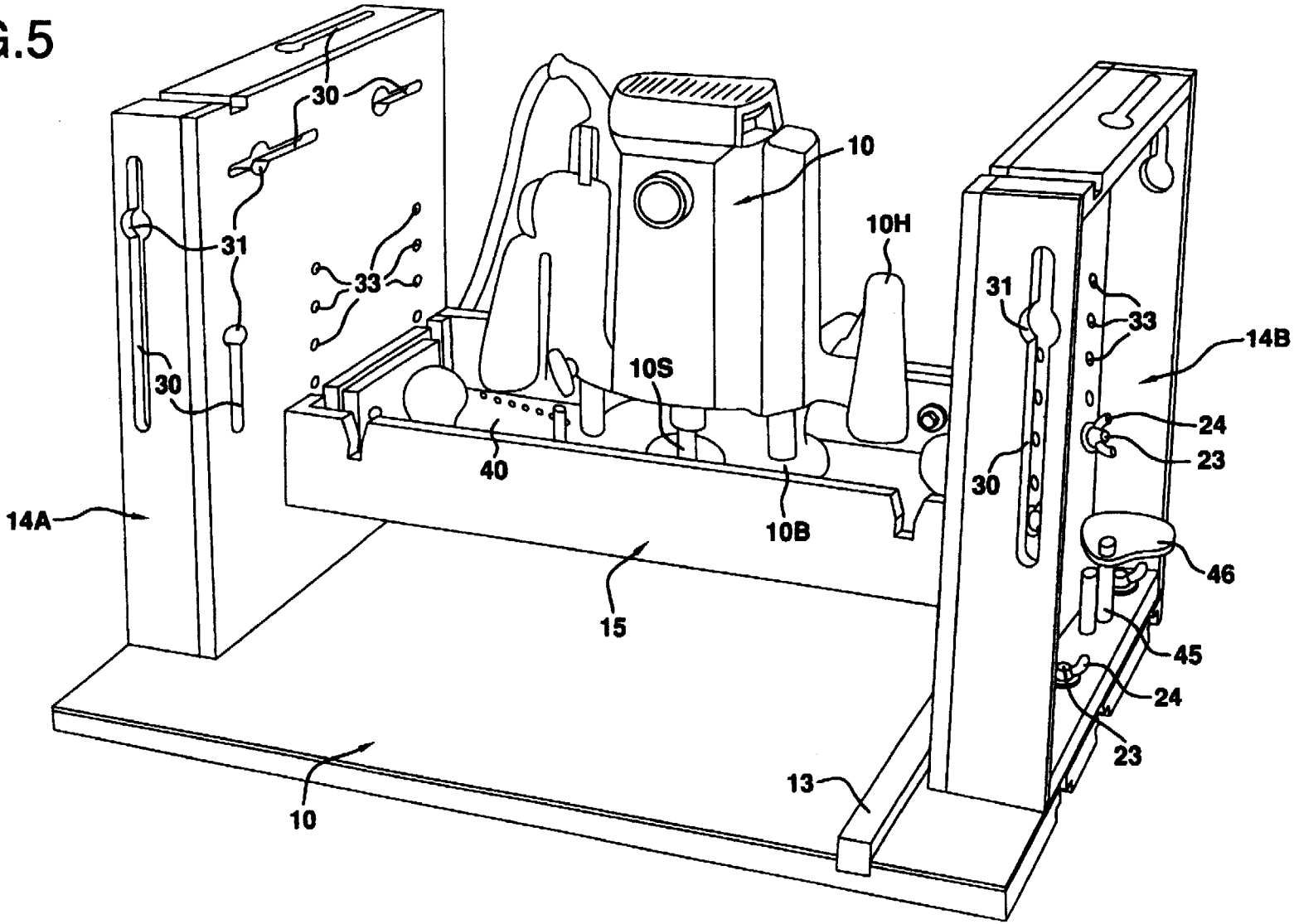
FIG. 5 is a perspective view showing the multi-purpose jig in the overhead router configuration.

FIG. 5 shows how the components fit together to make an overhead router. Some operations must be performed with the router held stationary above the work. For this configuration, attach the support boxes 14A, 14B are attached extending vertically from the base and the plate or bridge box 15 is bolted between them at a lower level, with the baseplate 40 facing down and the router 10 extending upward. The plate 40 should usually be less than an inch above the workpiece to be routed.

With the router bit rotating on a vertical axis above the workpiece, the user can pin rout e.g. use a pin and a template to guide the work while cutting signs, patterns, and other complex shapes. This configuration of the jig also can be used to rout cylindrical workpieces such as turned table legs and chair parts. By mounting a turning in a V-block, and then guiding the V-block along a straight edge, it is possible to rout mortises, slots, flutes, and reeds with great accuracy.

Dado and Rabbet Cutter

Figure 6:
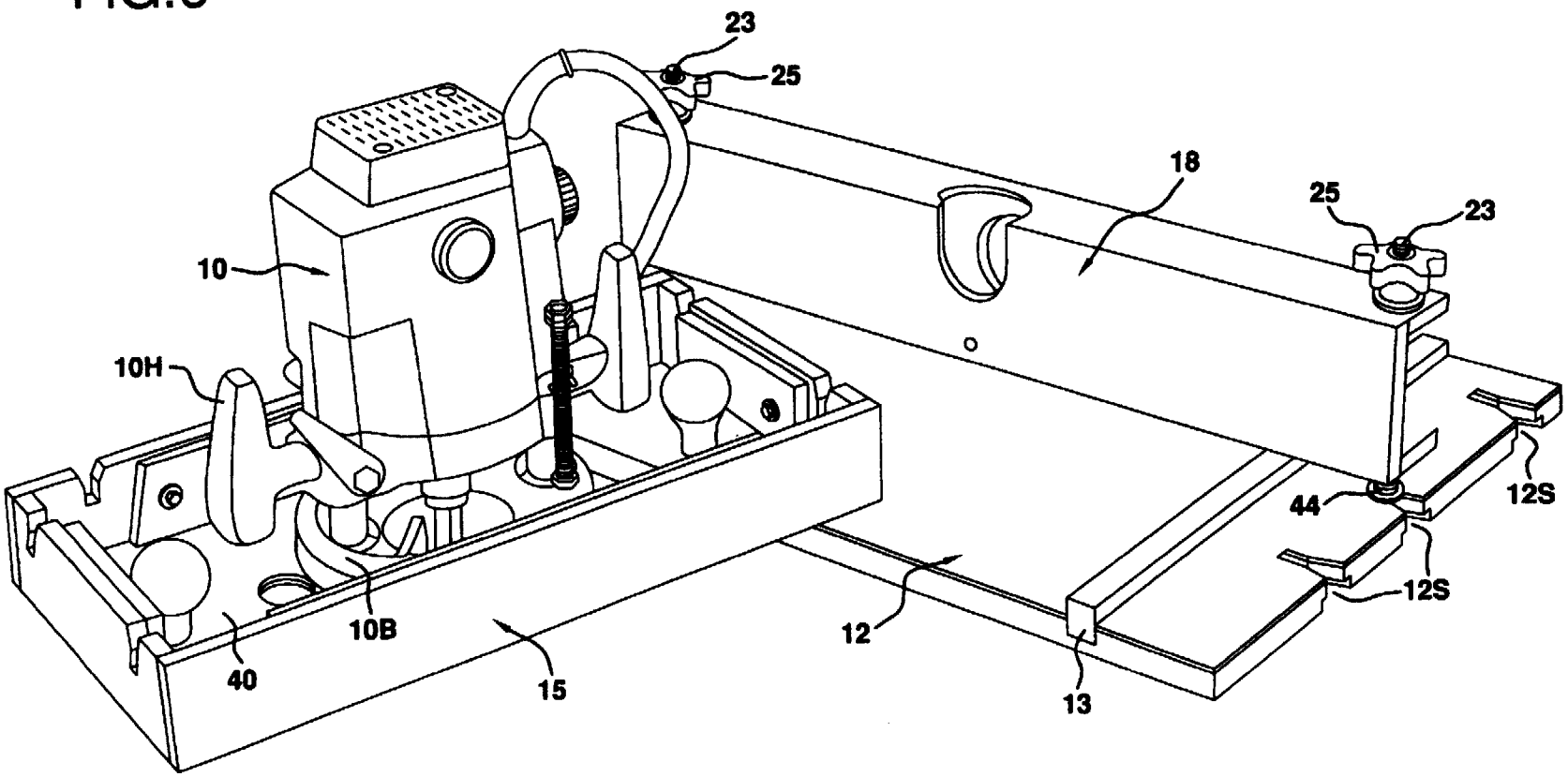
FIG. 6 is a perspective view showing the multi-purpose jig in the dado cutter configuration.

FIG. 6 shows the components fitted together to make a dado and rabbet cutter. To configure the jig for cutting dadoes and end rabbets longer carriage bolts 23 are used in the fence 18 with a pair of washers and coil springs 44 between them. The fence 18 is attached to base 12 as shown, with the springs and washers between them. The springs will raise the fence 18 when knobs 25 are loosened.

A board to be routed is slid under the fence 18, keeping it pressed against the stop rail 13. Knobs 25 are then tightened to clamp the board in place; stop rail 13 helps square the edge of the board to fence 18. A dado or rabbet an then be routed across the board, using fence 18 to guide the bridge 15 with baseplate 40 and the attached router 10. This configuration is especially useful for making dadoes and end rabbets in long boards such as shelving supports and the sides of cabinets.

Edge Guide

Figure 7:
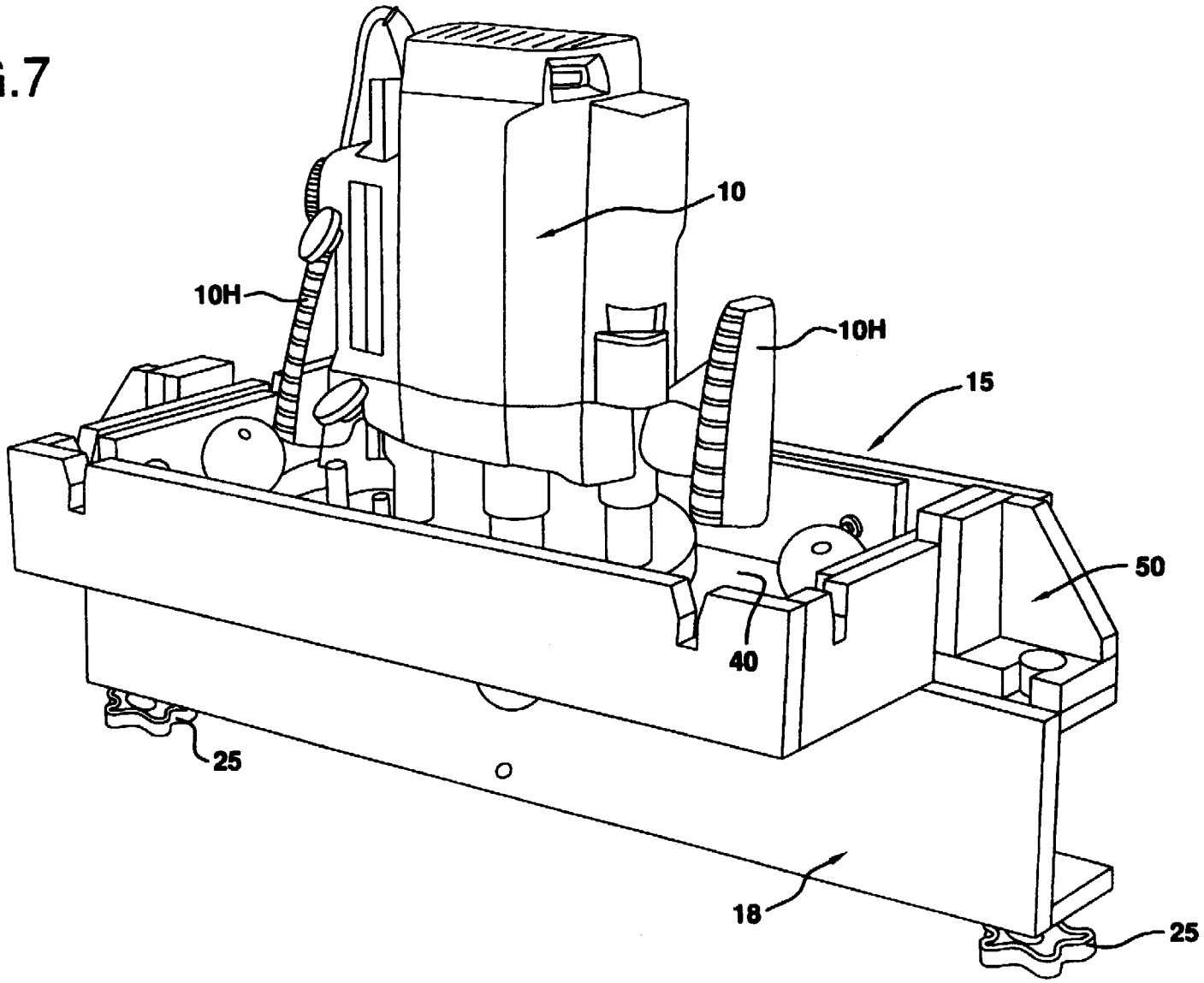
FIG. 7 is a perspective view showing the multi-purpose jig in the edge guide configuration.

FIG. 7 shows how some of the components fit together to make a portable edge guide. In this configuration, fence 18 is bolted to the bridge box 15 (inverted as in FIGS. 5 and 6) using the brackets 50 (see FIG. 2 also), as shown. The scales on the sides of bridge 15 can be used to help position fence 18.

The fence 18 is used to guide bridge 15 (with the baseplate and router) along the edge of a board to rout it, controlling the router and jig with router handles 10H. This setup is larger than commercially available edge guides, but the long fence 18 and the wide bridge or plate box 15 give superb control and provide dust collection. This configuration is useful to shape and/or square the edges of table tops or other large workpieces, to trim plastic laminate, and to cut grooves and edge rabbet in large boards.

Extended Router Base

Figure 8:
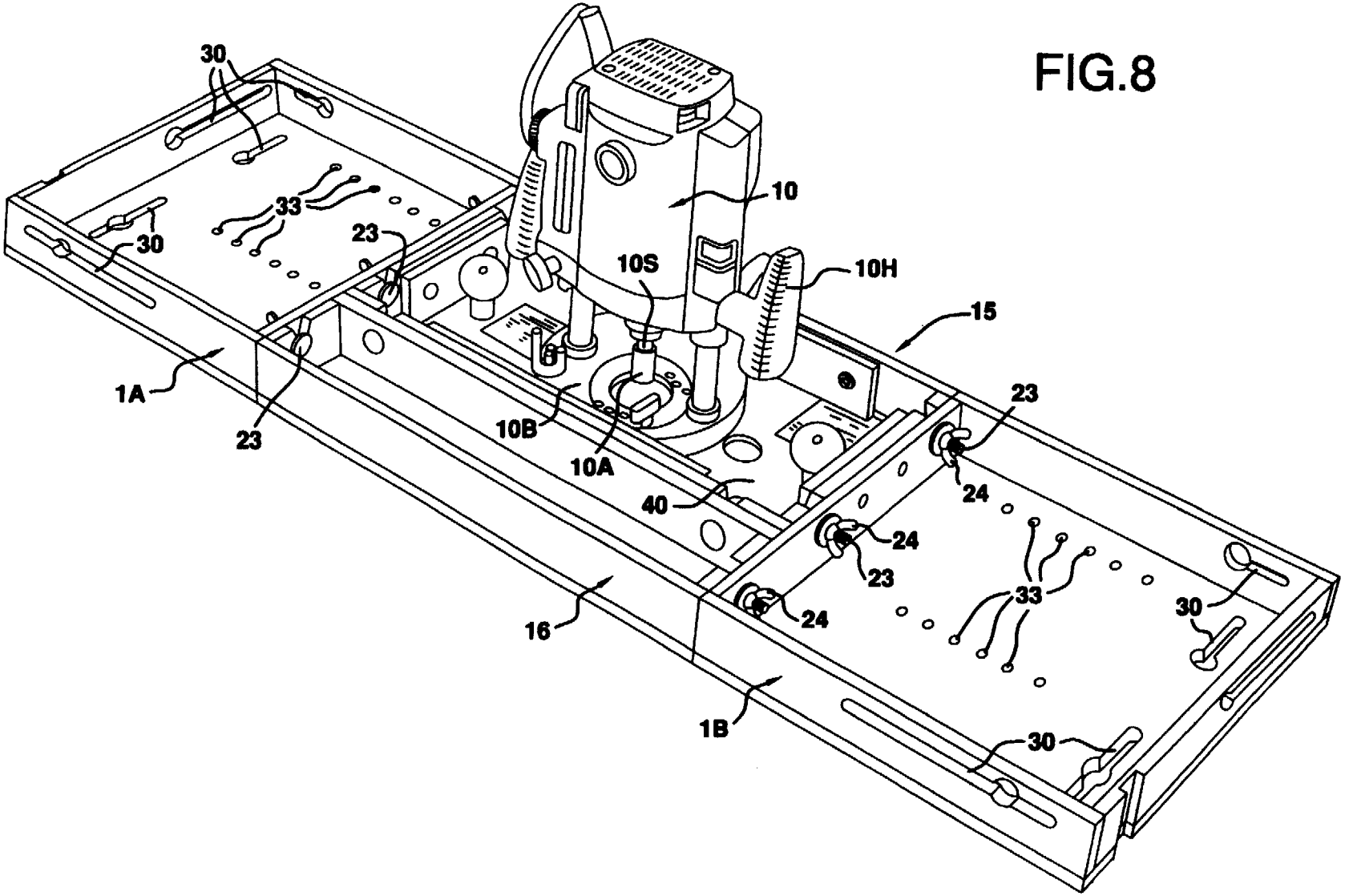
FIG. 8 is a perspective view showing the multi-purpose jig in the extended baseplate configuration.

FIG. 8 shows the jig configured as an extended router base. To form this extended router base, auxiliary bridge 16 is bolted to main bridge 15, then support boxes 14A, 14B are bolted to them as shown, with the support box sides facing down. It is also possible for both support boxes to be attached to one side of this subassembly. To achieve the latter configuration it is possible to bolt the bottom 14AD of one support box to the top 14BA of the other, then attach the bottom of one support box to the sides of the bridge and auxiliary subassembly.

With the aid of a planing jig (not shown), this configuration can be used to plane figured wood that would otherwise chip and tear if passed it through an ordinary planer. This extended base configuration will also remove slight warps, bows, and twists from lumber. By itself, the extended base configuration will scoop out the tops of trays, create lips around table tops, and cut circles over six feet in diameter.

Finally, the entire jig stores with no loose parts, preferably in the router table (FIG. 1) or the freehand table (FIG. 3) configurations. The starter pins and the pin guard screw into threaded receptacles in the right support box 14B. The long carriage bolts that are used while dadoing screw into the left support box 1$A, along with their washers and springs. The edge guide brackets can be bolted to the inside surfaces of the supports 14A and 14B.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A multi-purpose jig capable of erection in different configurations to provide corresponding different jigs for a portable router having a power driven rotatable shaft for holding and driving a rotary bit;

said multi-purpose jig including a plurality of interchangeable members capable of attachment to others of said members in different configurations;

said members comprising a base, a pair of side supports, a bridge, and a fence;

a router baseplate on said bridge providing the top surface of said bridge, means on said baseplate for supporting a router from said bridge with the router bit protruding upward through said baseplate;

said base, said supports, and said bridge are attached to each other in a box-like configuration with said baseplate facing upward to provide a free hand router table configuration with the router bit projecting upward through the baseplate.

2. A multi-purpose jig as defined in claim 1, wherein said fence is attached extending over and across said baseplate to provide a guide for workpieces passed over said baseplate along said fence and thus forming a router table configuration.

3. A multi-purpose jig as defined in claim 1, further including a bridge extension, and wherein said base, said supports, said bridge and said bridge extension are attached to each other in a box-like configuration with said baseplate facing upward to provide a free hand router table configuration with the router bit projecting upward through the baseplate, said fence being attached to one of said front and back supports to provide an enlarged working surface.

4. A multi-purpose jig as defined in claim 1, further including a bridge extension, and wherein said base, said supports and said bridge are attached to each other in a box-like configuration with said baseplate facing forward and oriented in a vertical plane to provide a horizontal router configuration, and said fence and said bridge extension are attached extending across and projecting forward from said baseplate to provide a guide for workpieces passed along said fence.

5. A multi-purpose jig as defined in claim 1, wherein said base, said supports and said bridge are attached to each other with said baseplate facing downward toward said base to provide an overhead router jig configuration.

6. A multi-purpose jig as defined in claim 1, wherein said fence is attached to said base to form an adjustable clamp configuration for work pieces in which dadoes or rabbets are to be formed.

7. A multi-purpose jig as defined in claim 1, wherein said fence is attached to said bridge in an edge guide configuration for the router independent of the other parts.

8. A multi-purpose jig as defined in claim 1, wherein said supports are attached to said bridge coplanar therewith in an extended baseplate configuration.

9. A multi-purpose jig capable of erection in different configurations to provide corresponding different jigs for a portable router having a power driven rotatable shaft for holding and driving a rotary bit, said multi-purpose jig including a base, a pair of side supports detachably fastened to said base in spaced parallel positions perpendicular to said base, a bridge having a top surface, sides, and a bottom, said bridge being capable of detachable fastening to and between said side supports in an elevated position with respect to said base, said bridge being capable of orientation with its top surface in both upright and inverted horizontal positions and in a vertical orientation between said side supports, and means for supporting a router from said bridge with the router bit protruding upward through said bridge.

10. A jig as defined in claim 9, wherein said side supports are also capable of detachable fastening to opposite sides of and coplanar with said bridge.

11. A jig as defined in claim 9, further including a fence extending across said bridge in a perpendicular orientation with respect to said top surface of said bridge.

12. A jig as defined in claim 9, further including a router baseplate on said bridge providing the top surface of said bridge.

13. A jig as defined in claim 12, further including means on said baseplate for securing a router thereto.

14. A jig as defined in claim 13, wherein said baseplate is a rigid transparent member.

15. A jig for supporting a router comprising a base, at least two side support structures, a bridge including a mounting baseplate forming a major part of a surface of said bridge, and a fence;

each of said support structures and said mounting bridge having a box construction including a top and sides attached to each other forming a rigid member;

said support structures having releasable attachments to said base, said bridge having releasable attachments to said support structures, and said baseplate having means for supporting a power driven router thereon projecting perpendicular to the bridge surface, and said fence having releasable attachments to said support structures, whereby attachment of said base and said bridge plate and said fence to said support structures forms a rigid box within which a power driven router can be secured to work upon pieces moved across said baseplate.

16. A jig as defined in claim 15, wherein said support structures are attached extending perpendicular to said base and said bridge is attached between said support structures spaced from said base, said support structures having front edges extending upward from said base and presenting forward facing attachment slots therein.

17. A jig as defined in claim 16, wherein said bridge is oriented with said bridge surface facing upward away from said base and the router is suspended from said bridge between said support structures and above said base, and said fence is coplanar with said bridge surface.

18. A jig as defined in claim 16, wherein said bridge is oriented with said bridge surface facing downward toward said base, and said fence is not attached to the jig.

19. A jig as defined in claim 16, wherein said bridge is oriented with said bridge surface extending vertically adjacent said front edges of said support structures, and said fence is secured to said attachment slots in said front edges of said support structures and extends across said bridge surface.

20. A jig as defined in claim 15, wherein said fence is attached only to said bridge and extending perpendicularly thereto for providing and edge guide jig.

21. A jig as defined in claim 15, wherein said fence is attached to said base extending perpendicular thereto and to said bridge.

22. A jig as defined in claim 15, wherein said support structures are attached to said bridge coplanar therewith forming an extended portable baseplate.

* * * * *